US006550881B1

(12) United States Patent
Phillips

(10) Patent No.: US 6,550,881 B1
(45) Date of Patent: Apr. 22, 2003

(54) FACILITATING SERVICING OF A DEPLETED CONTAINER

(75) Inventor: Quintin T. Phillips, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

(21) Appl. No.: 09/981,853

(22) Filed: Oct. 16, 2001

(51) Int. Cl.[7] ..... B41J 2/195; B41J 29/393
(52) U.S. Cl. ..... 347/7; 347/19
(58) Field of Search ..... 347/7–6, 19, 14, 347/23, 85, 86, 87, 47, 84

(56) References Cited

U.S. PATENT DOCUMENTS 5,589,861 A * 12/1996 Shibata ..... 347/22
6,048,045 A * 4/2000 Nohata et al. ..... 347/7
6,158,850 A * 12/2000 Cook ..... 347/85
6,209,980 B1 * 4/2001 Kobayashi et al. ..... 347/7
6,271,928 B1 * 8/2001 Bullock et al. ..... 358/1.16

* cited by examiner

*Primary Examiner*—Craig Hallacher
*Assistant Examiner*—Charles W. Stewart, Jr.

(57) ABSTRACT

Service of a container depleted of a consumable resource is facilitated in a device holding a plurality of containers for consumable resources. One of the plurality of containers for consumable resources is depleting of consumable resources. The container depleted of the consumable resource is discovered. The depleted container is discovered by either realizing the container has a low level of the consumable resource or is empty of the consumable resource. The amount of consumable resource in each container is discovered either by measuring the remaining consumable resource or by tracking indicia of the remaining consumable resource. In response to discovering the depleted container, the depleted container is moved into a service position. Optionally, an access to the depleted container is opened and the depleted container is ejected.

20 Claims, 2 Drawing Sheets

FACILITATING SERVICING OF A DEPLETED CONTAINER

FIELD OF THE INVENTION

This invention relates in general to servicing technology and, more particularly, to facilitating the service of a depleted container in a device having a plurality of containers.

BACKGROUND OF THE INVENTION

Often a device user is required to replace, or service, a depleted container in a device having a plurality of containers. For example, containers for toner, ink, paper, and other consumable resources are frequently depleted, requiring service before the device using the consumable is able to carry out its function.

One of the challenges before the user when faced with a container in need of service is correctly identifying the container in need of service. Many times in devices with multiple containers, the depleted container is not readily apparent. Simply viewing the device with the depleted container is not sufficient for identifying the depleted container. The containers may be opaque or not readily accessible.

Color laser printers represent one example of a device having multiple containers of consumable resources. Most color laser printer users transition from using a monochrome laser printer to a color laser printer. The user has learned to change toner cartridges in monochrome printers. In monochrome printers, the cartridge is readily available for changing when the consumable door is opened.

Color printers are more complex. In a carousel color printer, up to four cartridges may be present. If one of the cartridges is low or out of toner, the user is often expected to go to the printer and, by a specific button or procedure, rotate the carousel to place the cartridge of concern in position to be serviced. This may cause some confusion for the user. Additionally, the process requires additional time to complete the printer service as compared to a monochrome printer.

Conventional solutions for assisting a user in identifying the depleted container include providing information on a user display panel for identifying the depleted container. The information is usually either an error code or a graphical representation of the depleted container with respect to the entire device. Often the information provided on the display on the display panel is inadequate alone and the user must additionally reference a manual for the device in order to correctly identify and remove the depleted container.

SUMMARY OF THE INVENTION

According to principles of the present invention, service of a container depleted of a consumable resource is facilitated in a device holding a plurality of containers for consumable resources. One of the plurality of containers for consumable resources is depleted of consumable resources. The container depleted of the consumable resource is discovered. In response to discovering the depleted container, the depleted container is moved into a service position.

According to further principles of the present invention, the depleted container is discovered by either realizing the container has a low level of the consumable resource or is empty of the consumable resource.

According to further principles of the present invention, the amount of consumable resource in each container is discovered either by measuring the remaining consumable resource or by tracking indicia of the remaining consumable resource.

According to further principles of the present invention, an access to the depleted container is opened and the depleted container is ejected.

DETAILED DESCRIPTION OF THE INVENTION

Figure 1:
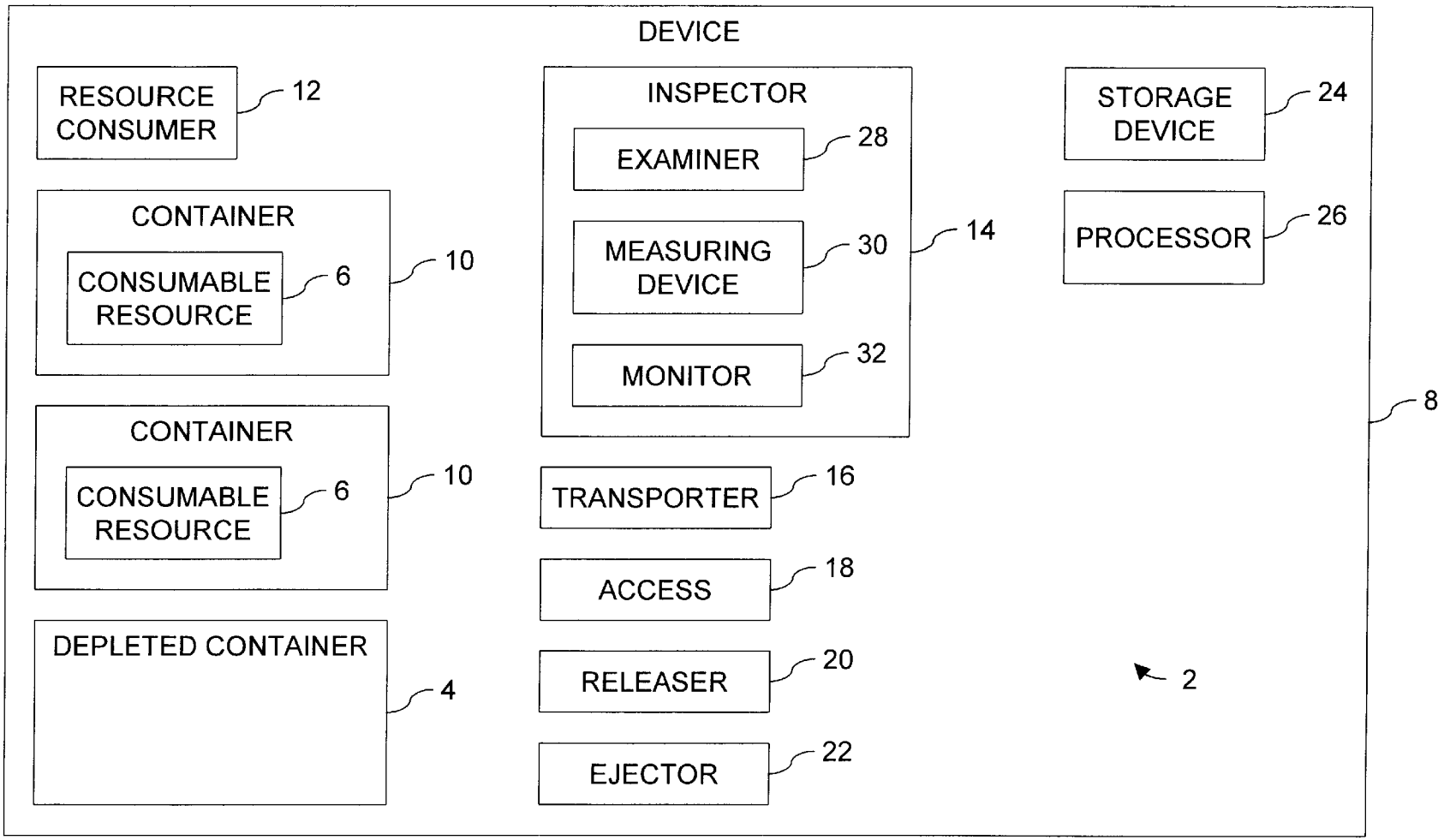
FIG. 1 is a block diagram representing one embodiment of the system of the present invention for facilitating service of a container depleted of a consumable resource, in a device holding a plurality of containers for consumable resources.

Illustrated in FIG. 1 is a system 2 for facilitating service of a container 4 depleted of a consumable resource 6, in a device 8 holding a plurality of containers 4, 10 for consumable resources 6. System 2 includes containers 4, 10 for consumable resources 6, a resource consumer 12, an inspector 14, and a transporter 16. Optionally, system 2 further includes access 18, releaser 20, ejector 22, storage system 24, and processor 26.

Device 8 is any type of device holding a plurality of containers 4, 10. Examples of device 8 include a printer, a copier, a facsimile machine, and a multifunction device.

Consumable resources 6 are any type of resources consumed by a device 8. Examples of consumable resources 6 include paper, toner, ink, staples, and tape.

Containers 4, 10 are any type of container for holding consumable resources 6. The size, shape, and configuration of containers 4, 10 are suited to the consumable resource 6. Examples of containers 4, 10 are paper trays for consumable paper resources, toner cartridges for consumable toner resources, and ink cartridges for consumable ink resources.

Depleted container 4 is a container that either has a low level of consumable resource 6 or is empty of consumable resource 6. A low level of consumable resource 6 is defined by convention and as desirable, depending on the resource. Many devices already provide an indication of a low level of consumable resource 6, such as paper, toner, and ink. A level of consumable resource 6 consistent with a low level indication is one example of a low level.

Resource consumer 12 is any apparatus or system operable to consume consumable resources 6. One example of resource consumer 12 includes an imaging system operable to consume paper resources and ink or toner resources.

Inspector 14 is any combination of hardware and executable code configured to discover container 4 depleted of consumable resource 6. In one embodiment, inspector 14 includes examiner 28 and any combination of measuring device 30 and monitor 32.

In one embodiment, examiner 28 is any combination of hardware and executable code configured to realize depleted container 4 is empty of consumable resource 6. In an alternate embodiment, examiner 28 is any combination of hardware and executable code configured to realize depleted container 4 has a low level of consumable resource 6.

Measuring device 30 is any apparatus or system configured to measure the remaining consumable resource 6 in each container 4, 10. One example of measuring device 30 is a device for measuring the capacitance in a toner cartridge. The amount of toner in the toner cartridge is determined from the capacitance measurement.

Monitor 32 is any combination of hardware and executable code configured to track indicia of the remaining consumable resource 6 in each container 4, 10. For example, a counter tracks the number of pages printed in a printer. The toner remaining in a toner cartridge is approximately related to the number of pages printed using the cartridge. The number of pages printed is indicia of the remaining toner in a toner cartridge. The amount of toner remaining in the toner cartridge is approximately predictable from the page count indicia.

Transporter 16 is any apparatus or system configured to respond to the discovery of depleted container 4 by moving depleted container 4 into a service position. Examples of transporter 16 include a carousel and a conveyor system. A service position is a position from which depleted container 4 may be service. For example, a cartridge carousel in a color laser printer may have several positions which each cartridge may inhabit, only one of which allows a user access to the cartridge to service the cartridge.

Access 18 is any type of access, such as a door, panel, drawer, tray, or cover.

Releaser 20 is any apparatus or system configured to open access 18. Examples of releaser 20 include spring released and motor driven opening devices for access 18.

Ejector 22 is any apparatus or system configured to eject depleted container 4. Examples of ejector 22 include spring released and motor driven ejection devices.

Storage system 24 is any system for storing data or executable code. Storage system 24 may also be a program storage system tangibly embodying a program, applet, or instructions executable by processor 26 for performing the method steps of the present invention executable by processor 26. Storage system 24 may be any type of storage media such as magnetic, optical, or electronic storage media. Storage system 24 is illustrated in FIG. 1 as a single device. Alternatively, storage system 24 may include a plurality of devices. Furthermore, each device of storage system 24 may be embodied in a different media type. For example, one device of storage system 24 may be a magnetic storage media while another device of storage system 24 is an electronic storage media.

All or portions of resource consumer 12, inspector 14, transporter 16, releaser 20, and ejector 22 may reside on storage device 24 as executable code or data.

Processor 26 is any apparatus or system configured to process executable code.

Figure 2:
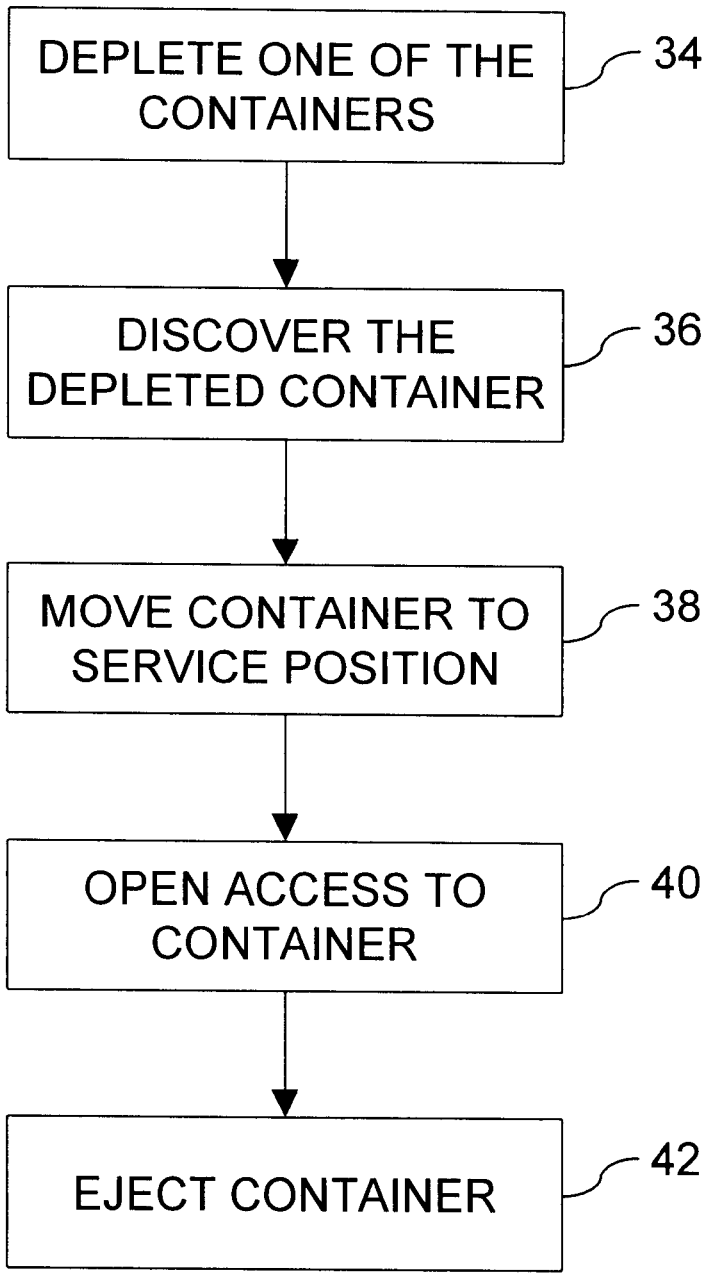
FIG. 2 is a flow chart illustrating one embodiment of the method of the present invention for facilitating service of a container depleted of a consumable resource, in a device holding a plurality of containers for consumable resources.

FIG. 2 is a flow chart representing steps of one embodiment of the present invention. Although the steps represented in FIG. 2 are presented in a specific order, the present invention encompasses variations in the order of steps. Furthermore, additional steps may be executed between the steps illustrated in FIG. 2 without departing from the scope of the present invention.

One of the plurality of containers 4, 10 for consumable resources 6 is depleted 34. In one embodiment, depleting 34 one of the plurality of containers 4, 10 includes processing an output job. It is possible that more than one of the containers 4,10 may be depleted. Where more than one of the containers 4,10 is depleted, either a preliminary judgement is made concerning which of the depleted containers 4 is the most depleted, or some other judgement is made as to which of the depleted containers 4 is first serviced.

The container 4 depleted of the consumable resource is discovered 36. In one embodiment, the depleted container 4 is discovered 36 by realizing the container is empty of consumable resource 6. In an alternated embodiment, the depleted container 4 is discovered 36 by realizing the container has a low level of consumable resource 6.

In one embodiment, discovering 36 the depleted container 4 includes measuring the remaining consumable resource in each container. In an alternated embodiment, discovering 36 the depleted container 4 includes tracking indicia of the remaining consumable resource in each container.

In response to discovering 36 depleted container 4, the depleted container is moved 38 into a service position. Where depleted container 4 has a low level of consumable resource 6, and where depleting one of the plurality of containers includes processing an output job, the output job may be completed before moving 38 the depleted container into a service position.

Optionally, access 18 to depleted container 4 is opened 40. Also optionally, and not dependent on opening 40 access 18, depleted container 4 may be ejected 42.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. A method for facilitating service of a container depleted of a consumable resource, in a device holding a plurality of containers for consumable resources, the method comprising:

(a) depleting one of the plurality of containers for consumable resources;

(b) discovering the container depleted of the consumable resource; and, (c) responsive to discovering the depleted container, moving the depleted container into a service position.

2. The method of claim 1 wherein discovering the depleted container includes realizing the depleted container has a low level of the consumable resource.

3. The method of claim 2 wherein depleting one of the plurality of containers includes processing an output job and further including completing the output job before moving the depleted container into a service position.

4. The method of claim 1 wherein discovering the depleted container includes realizing the depleted container is empty of the consumable resource.

5. The method of claim 1 wherein discovering the depleted container includes measuring the remaining consumable resource in each container.

6. The method of claim 1 wherein discovering the depleted container includes tracking indicia of the remaining consumable resource in each container.

7. The method of claim 1 further including opening an access to the depleted container.

8. The method of claim 1 further including ejecting the depleted container.

9. A system for facilitating service of a container depleted of a consumable resource, in a device holding a plurality of containers for consumable resources, the system comprising:

(a) a resource consumer configured to deplete containers of consumable resources;

(b) an inspector configured to discover the container depleted of the consumable resource; and, (c) a transporter configured to respond to the discovery of the depleted container by moving the depleted container into a service position.

10. The system of claim 9 wherein the inspector includes an examiner configured to realize the depleted container has a low level of the consumable resource.

11. The system of claim 9 wherein the inspector includes an examiner configured to realize the depleted container is empty of the consumable resource.

12. The system of claim 9 wherein the inspector includes a measuring device configured to measure the remaining consumable resource in each container.

13. The system of claim 9 wherein the inspector includes a monitor configured to track indicia of the remaining consumable resource in each container.

14. The system of claim 9 wherein the device includes an access to the depleted container, further including a releaser configured to open the access.

15. The system of claim 9 further including an ejector configured to eject the depleted container.

16. A program storage system readable by a computer, tangibly embodying a program, applet, or instructions executable by the computer to perform method steps for facilitating service of a container depleted of a consumable resource, in a device holding a plurality of containers for consumable resources, the method steps comprising:

(a) depleting one of the plurality of containers for consumable resources;

(b) discovering the container depleted of the consumable resource; and, (c) responsive to discovering the depleted container, moving the depleted container into a service position.

17. The program storage system of claim 16 wherein the method step of discovering the depleted container includes realizing the container has a low level of the consumable resource.

18. The program storage system of claim 16 wherein the method step of discovering the depleted container includes realizing the container is empty of the consumable resource.

19. The program storage system of claim 16 wherein the method step of discovering the depleted container includes measuring the remaining consumable resource in each container.

20. The program storage system of claim 16 wherein the method step of discovering the depleted container includes tracking indicia of the remaining consumable resource in each container.

* * * * *